US006983700B1

(12) United States Patent
Malejko et al.

(10) Patent No.: US 6,983,700 B1
(45) Date of Patent: Jan. 10, 2006

(54) VARIABLE DRAG PROJECTILE STABILIZER FOR LIMITING THE FLIGHT RANGE OF A TRAINING PROJECTILE

(75) Inventors: Gregory Malejko, Hackettstown, NJ (US); Anthony Vella, East Hanover, NJ (US); Eric P. Scheper, Essex Fells, NJ (US); Philip M. Donadio, Long Valley, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 150 days.

(21) Appl. No.: 10/709,401

(22) Filed: May 3, 2004

(51) Int. Cl.
*F42B 8/00* (2006.01)

(52) U.S. Cl. ..... 102/529; 102/501; 102/498; 244/3.24

(58) Field of Classification Search ..... 102/501, 102/529, 526, 386, 388, 395, 498; 244/3.24, 244/3.3

See application file for complete search history.

(56) References Cited

U.S. PATENT DOCUMENTS 4,153,223 A * 5/1979 Romer et al. ..... 244/3.1
6,453,820 B1 * 9/2002 Anderson ..... 102/503
6,629,669 B2 * 10/2003 Jensen ..... 244/3.23
6,655,293 B1 * 12/2003 Henry et al. ..... 102/439

* cited by examiner

*Primary Examiner*—J. Woodrow Eldred
(74) *Attorney, Agent, or Firm*—Michael C. Sachs; John F. Moran

(57) ABSTRACT

A variable drag projectile stabilizer is utilized by a training projectile to match the trajectory of a tactical projectile for up to 3 km while having a range limitation of 8 km. The stabilizer applies supersonic flow phenomena to alter the aerodynamic characteristics of a training projectile while in free flight to fulfill this requirement. The stabilizer uses a cowling supported by struts to provide tail lift and ensure a stable flight path. Supersonic flow is established through ducts formed by the cowling and struts when launched from a weapon. The flow remains supersonic until the projectile reaches the desired range but then quickly becomes subsonic (choked) due to shock waves emanating from interior angles in the ducts. The geometry of the ducts can be designed to create different shock wave patterns within the ducts. The variance of leading edge location, leading edge angle, cowling intake angle, and flight Mach number influences the shock patterns within the ducts and consequently, the range of the projectile.

1 Claim, 11 Drawing Sheets

VARIABLE DRAG PROJECTILE STABILIZER FOR LIMITING THE FLIGHT RANGE OF A TRAINING PROJECTILE

FEDERAL RESEARCH STATEMENT

The inventions described herein may be manufactured, used and licensed by or for the U.S. Government for U.S. Government purposes.

BACKGROUND OF INVENTION

Field of the Invention

The present invention relates to a tank training projectile. More particularly this invention pertains to a training projectile with an effective range that can be regulated by means of a variable drag projectile stabilizer. In specific, the present invention utilizes supersonic airflow to change the aerodynamics of the training projectile during flight, thus matching the flight characteristics of a corresponding service ammunition during the initial part of the flight while not exceeding a predetermined range of the training projectile.

BACKGROUND OF THE INVENTION

The Army has an on-going need for long-range kinetic energy projectiles for use in artillery and tank training. For effective training, ballistic characteristics of a training munition should match that of a corresponding battlefield or service ammunition as closely as possible. An example of service ammunition for which a training projectile is used is an armor piercing discarding sabot (APDS) kinetic energy projectile. For maximum effectiveness, the trajectory of the training projectile should closely resemble the trajectory of the armor piercing discarding sabot (APDS) kinetic energy projectile for ranges up to 3 km. Further, the maximum range of the training projectile should be no more than 8 km to confine the training projectile to the boundaries of the training range. While current technology is able to match trajectories at shorter distances (up to 2 km), a primary difficulty is in matching the trajectory of the armor piercing discarding sabot (APDS) kinetic energy projectile at longer distances (up to 3 km) while limiting the range to 8 km.

A conventional long range kinetic energy training projec–tile used by the U.S. Army is the Cartridge 120 mm, TPCSDS-T M865 (Target Practice Cone Stabilized Discarding Sabot). A series of slots cut along the top of the flare at an angle to the projectile's longitudinal axis imparts a roll torque to the projectile. While not required for aerodynamic stability, this spin improves the projectile's flight accuracy. Although this technology has proven to be useful, it would be desirable to present additional improvements.

The M865 has a high aerodynamic drag. Consequently, the M865 is launched at a greater muzzle velocity to match the trajectory of a tactical armor piercing discarding sabot (APDS) kinetic energy. This greater initial velocity causes the trajectory of the M865 in an initial 2 km of flight to be slightly higher than the trajectory of the armor piercing discarding sabot (APDS) kinetic energy projectile over the same range. This small deviation or mismatch in trajectory by the training projectile compared to the service ammunition is within acceptable bounds. However, the high aerodynamic drag of the M865 causes significant deceleration beyond 2 km. Consequently, the flight path of the M865 is well below the trajectory of an armor piercing discarding sabot (APDS) kinetic energy projectile at ranges beyond 2 km. At ranges beyond 3 km, the mismatch in trajectory becomes undesirably large.

A self-destructing training projectile for the armor piercing discarding sabot (APDS) kinetic energy projectile uses aerodynamic heating to melt a portion of the self-destructing training projectile, causing the self-destructing training projectile to disintegrate in flight prior to reaching the maximum allowed range. Reference is made here to U.S. Pat. No. 4,413,566, which is incorporated by reference.

Although this technology has proven to be useful, it would be desirable to present additional improvements. Accurate range limitation for the self-destructing training projectile is difficult to obtain due to the temperature dependency of the self-destruction mechanism. At lower temperatures, melting of the part of the self-destructing training portion is delayed. Consequently, the self-destructing training projectile may not disintegrate within the desired 8 km maximum range.

A mechanically adjusting training projectile employs moving mechanical parts to alter the mass distribution of the mechanically adjusting projectile in flight. Reference is made here to U.S. Pat. No. 4,596,191 which is incorporated by reference. As the center of gravity of the mechanically adjusting training projectile shifts, the mechanically adjusting training projectile becomes statically unstable, resulting in a high angle of attack motion. Although this technology has proven to be useful, it would be desirable to present additional improvements. The mechanically adjusting training projectile is expensive. In addition, a failure in the moving mechanical parts allows the projectile to travel well beyond the maximum desired range.

The range of a dynamically unstable training projectile can be limited by launching from a smooth bore weapon, creating a dynamic instability. Reference is made here to U.S. Pat. Nos. 5,125,344 and 6,123,289 that are incorporated by reference. The dynamic instability creates a spin near the natural pitching frequency of the dynamically unstable training projectile, causing an amplification of the trim vector and subsequently causing a high angle of attack motion. The high angle of attack limits the range of the dynamically unstable training projectile. Although this technology has proven to be useful, it would be desirable to present additional improvements. To be effective, the dynamically unstable projectile must have a very large trim amplification factor and a relatively large aerodynamic trim angle that can be amplified by a resonant motion. If the trim angle is insufficient, the dynamically unstable projectile is not driven to a high angle of attack and the dynamically unstable projectile flies beyond the maximum desired range.

What is needed is a training projectile that accurately matches the trajectory of a service ammunition such as, for example, a tactile armor piercing discarding sabot (APDS) kinetic energy projectile for an initial 3 km of flight. Further, range of the training projectile should be limited to 8 km to minimize the possibility of the flight of the training projectile exceeding the training range boundaries and subsequently causing the training projectile to pose a danger to non-military personnel. The training projectile should be cost effective and easily manufactured. The need for such a training projectile has heretofore remained unsatisfied.

SUMMARY OF INVENTION

The present invention satisfies this need, and presents a limited range training projectile stabilizer for a kinetic energy training projectile. The variable drag projectile stabilizer is a passive device that applies supersonic flow phenomena to alter the aerodynamic characteristics of a projectile while in free flight. The variable drag projectile stabilizer enables a training projectile to follow the trajectory path of an armor piercing discarding sabot (APDS) kinetic energy projectile for an initial 3 km of flight while limiting the range of the training projectile to 8 km.

The variable drag projectile stabilizer uses a cowling supported by struts to provide tail lift and ensure a stable flight path. The struts extend beyond the aft end of the cowling to carry the setback load of the cowling during acceleration in the gun tube. The cowling and struts form tubular ducts in parallel with a longitudinal axis of the training projectile.

When the training projectile is launched, supersonic flow is established through the ducts. The flow through the ducts remains supersonic until the training projectile reaches the target location. The supersonic flow through the ducts ensures that the training projectile flies downrange with a relatively low aerodynamic drag. The low aerodynamic drag enables the trajectory of the training projectile to closely match the flight trajectory of the service ammunition that the training projectile is designed to emulate.

As the training projectile decelerates during flight, the supersonic flow through the ducts approaches subsonic flow. To limit the maximum possible range of the training projectile, the variable drag projectile stabilizer is designed to experience a transition to subsonic (choked) flow through the ducts slightly beyond a location of a target. The ensuing rapid increase in aerodynamic drag severely limits further flight. Design details of the strut and cowling control the Mach number at which the high drag phenomenon begins, and thus the range of the training projectile.

After the training projectile is launched from a weapon, the approaching supersonic airflow passes over shallow angles in the cowling and strut configuration, forming oblique shock waves. The angle of obliquity of the shock waves is dependent upon the Mach number and the surface incidence angle of the airflow. At high Mach numbers, the oblique shock angles are shallow. Consequently, the shocks emanating off the leading edges of the struts and cowling do not intersect, maintaining supersonic flow through the ducts.

As the training projectile flies down range, aerodynamic drag decelerates the training projectile, decreasing the Mach number. As the Mach number decreases, the air pressure entering the ducts decreases and the oblique shock angles increase. The shocks emanating off the leading edges of the struts and cowling intersect, further increasing the aerodynamic drag. As the training projectile further decelerates, the speed of the training projectile becomes too slow to maintain supersonic flow through the ducts. Consequently, the airflow through the ducts becomes subsonic (choked) and the aerodynamic drag acting upon the tail increases substantially.

The geometry of the duct can be designed to create different shock wave patterns within the duct. The variance of leading edge location, leading edge angle, cowling intake angle, and flight Mach number influences the shock patterns within the ducts.

Target accuracy is enhanced by creating spin along the longitudinal axis of the projectile. In an embodiment, spin is induced by manipulating the geometry of the struts. In another embodiment, spin is induced by placing angled strakes around the periphery of the cowling. Strakes provide a roll torque to spin the projectile as well as act as a bore rider, protecting the cowling from balloting in the gun tube.

When the projectile is launched, gun gases flow forward through the ducts creating a significantly higher pressure inside the cowling than outside the cowling. To equalize pressure, the outside diameter of the cowling is designed smaller than the gun bore, allowing the gun gases to flow outside the cowling. In an embodiment, the trailing edges of the cowling are scalloped to allow the gun gases to escape more rapidly to the outside of the cowling.

BRIEF DESCRIPTION OF DRAWINGS

The various features of the present invention and the manner of attaining them is described in greater detail with reference to the following description, claims, and drawings, wherein reference numerals are reused, where appropriate, to indicate a correspondence between the referenced items, and wherein:

DETAILED DESCRIPTION

Figure 1:
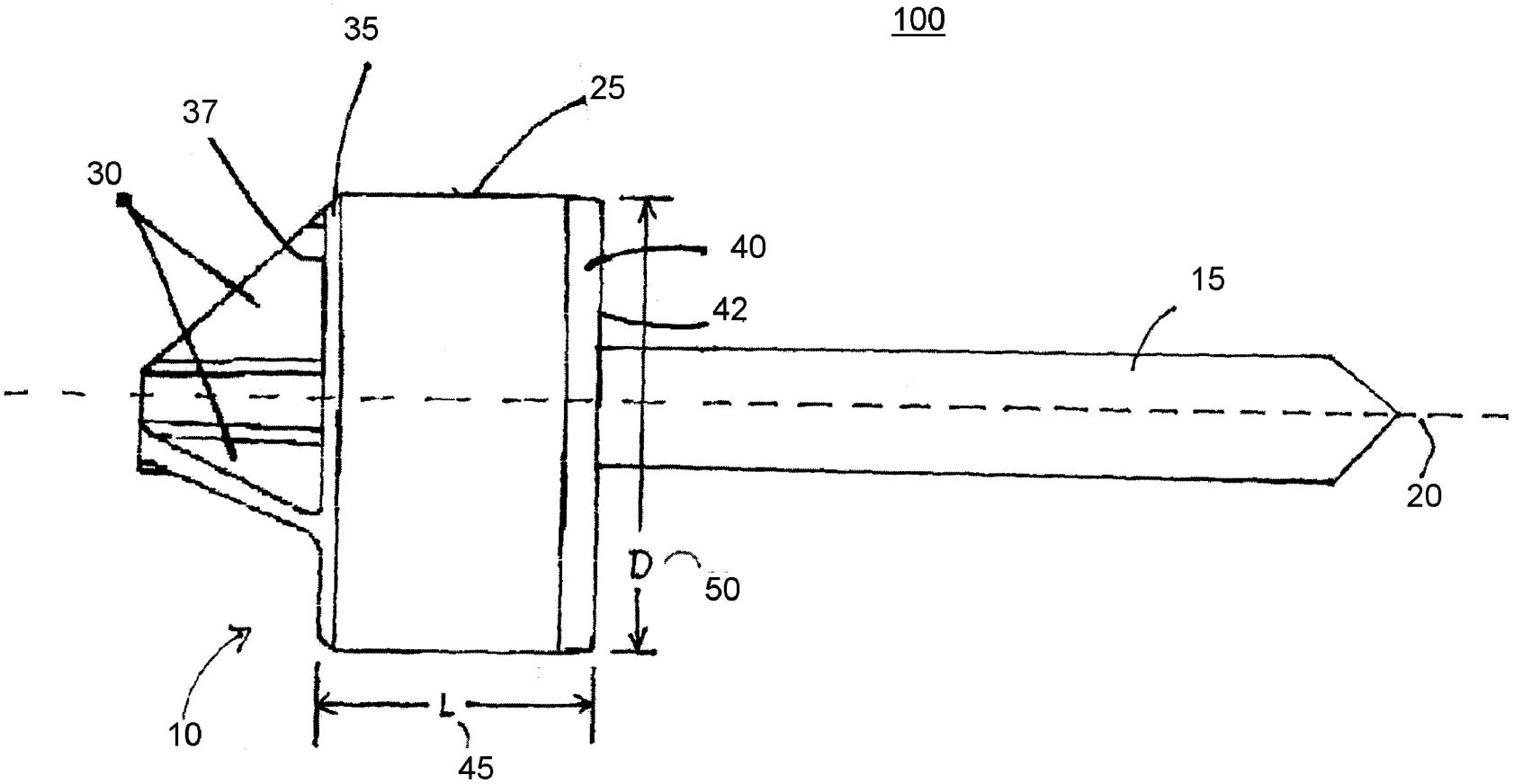
FIG. 1 is diagram of an example kinetic energy training projectile in which a variable drag projectile stabilizer of the present invention is used.

FIG. 1 illustrates an exemplary training projectile 100 comprising a variable drag projectile stabilizer 10 that utilizes supersonic airflow to change the aerodynamics of the training projectile 100 during flight. The variable drag projectile stabilizer 10 (also referenced herein as stabilizer 10) is mounted on a tail end of a cone-tipped cylindrical rod 15. Stabilizer 10 is cylindrical with respect to axis 20. Stabilizer 10 comprises a cowling 25 supported by struts 30. The cowling 25 and the struts 30 provide tail lift and ensure a stable flight path of the training projectile 100.

Struts 30 extend beyond the trailing edge 37 of cowling 25 to support a setback load or force experienced by cowling 25 during a gun launch of the training projectile 100. Cowling 25 comprises a trailing edge bevel 35, a leading edge bevel 40 and an angled interior surface 415. The cowling 25 and struts 30 are typically made of a lightweight metal, such as aluminum or titanium. However, composite materials may also be used. The length L, 45, of the cowling 25 is approximately 2.5 inches. The diameter D, 50, of the cowling 25 is approximately 3.75 inches. In an embodiment, the length L, 45, of the cowling 25 may range from approximately 1.0 inch to approximately 4.0 inches. In a further embodiment, the diameter D, 50, of the cowling 25 may range from approximately 3.0 inches to approximately 5.0 inches.

Figure 2:
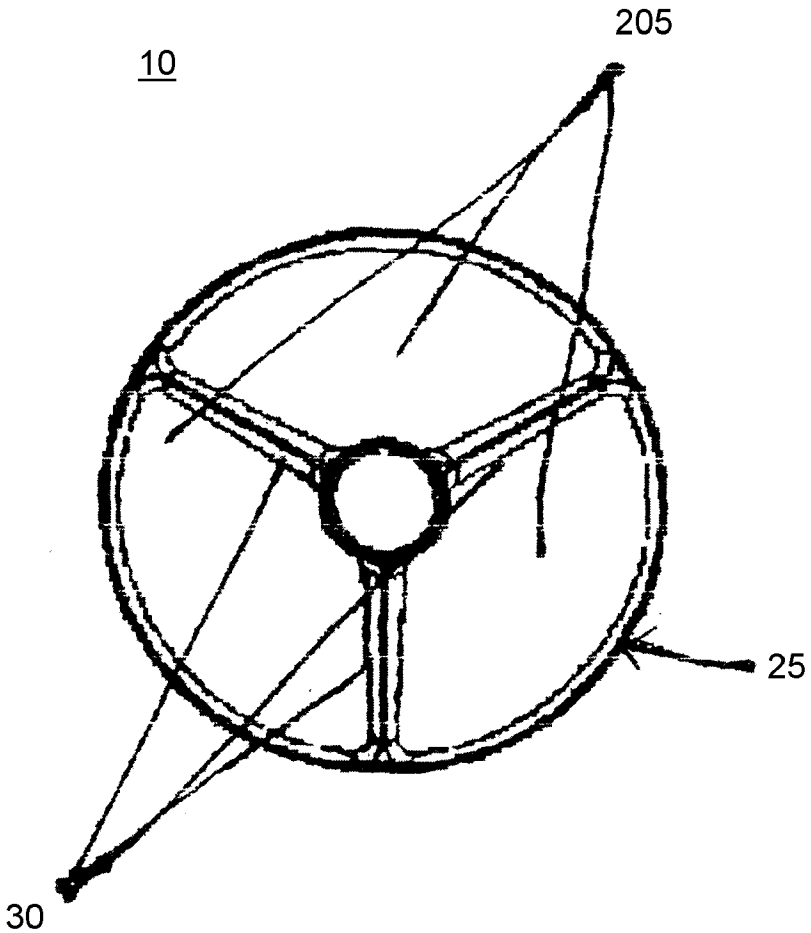
FIG. 2 is an end view of the cowling and interior struts of the variable drag projectile stabilizer of FIG. 1.
Figure 3:
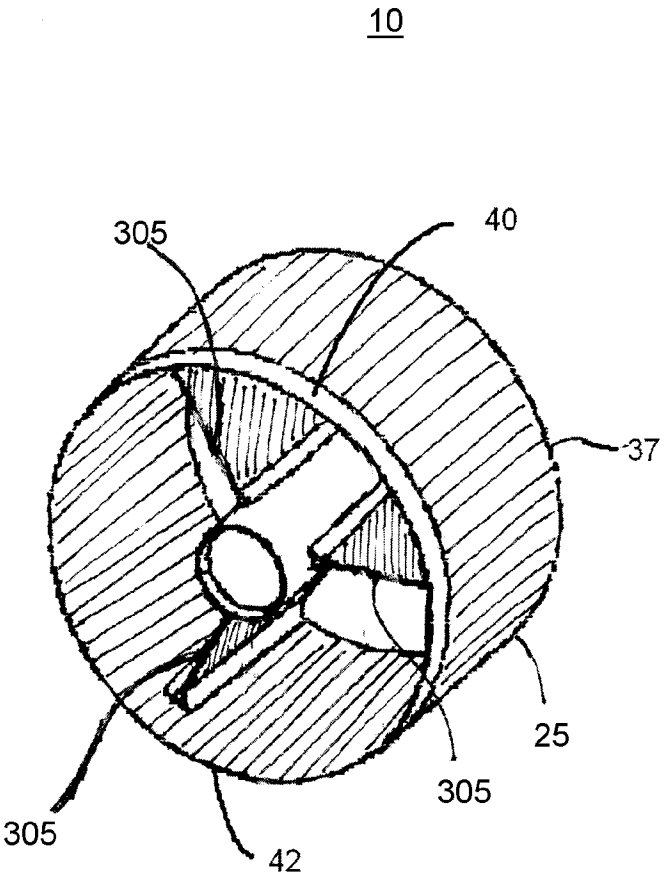
FIG. 3 is an oblique view of a leading edge of the cowling, the interior struts, and ducts of the variable drag projectile stabilizer of FIG. 1.

FIG. 2 illustrates an end view of stabilizer 10 showing the relative position of cowling 25 and struts 30. The cowling 25 and struts 30 form ducts 205. Ducts 205 are roughly tubular in shape; a longitudinal axis of each of the ducts 205 and the longitudinal axis 20 are parallel. FIG. 3 is an oblique view of the stabilizer 10 illustrating leading edges 305 of struts 30 and further illustrating the leading edge bevel 40 of the cowling 25. The leading edges 305 of struts 30 are recessed with respect to the leading edge 42 of cowling 25.

Figure 4A:
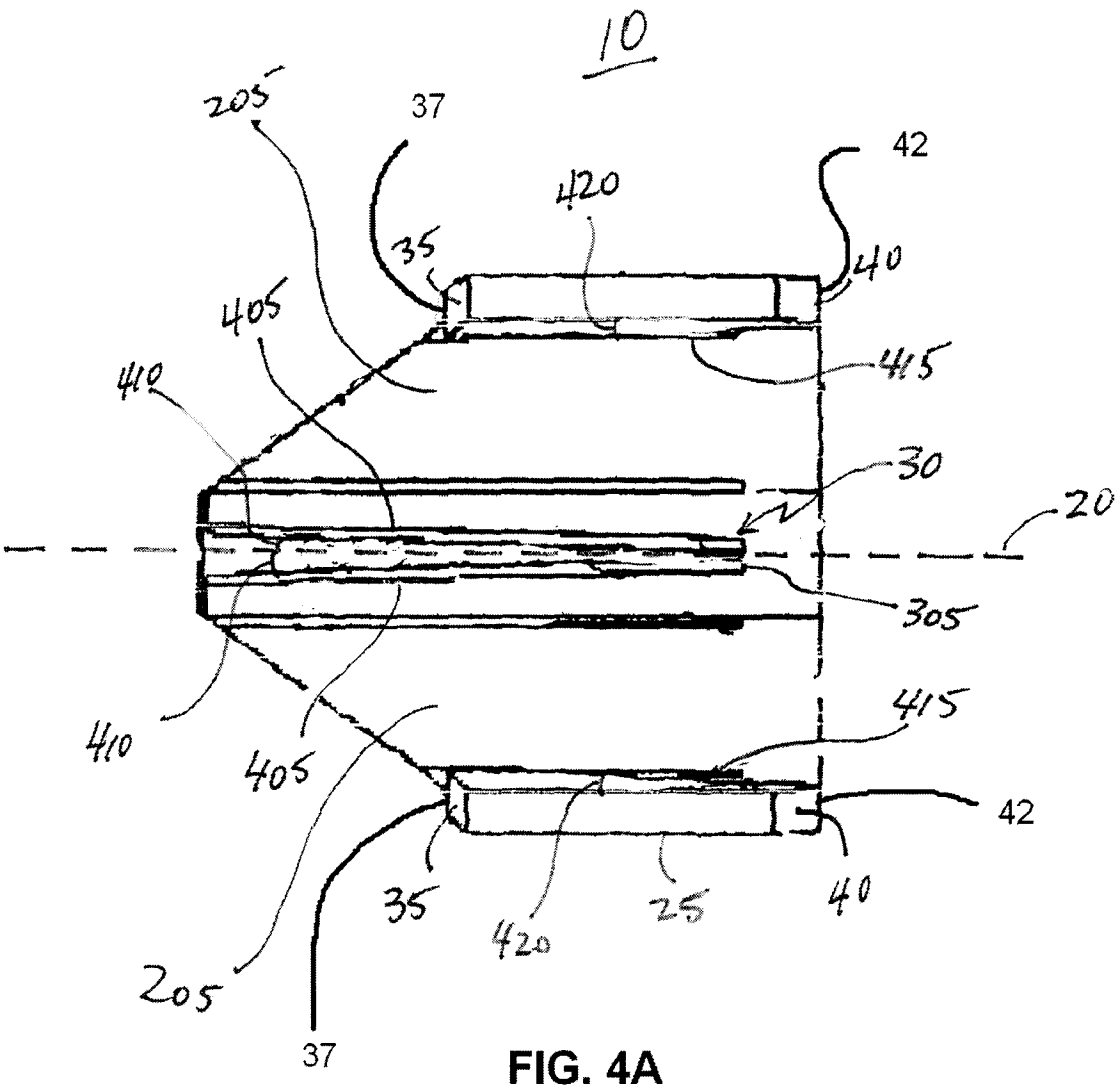
FIG. 4A is a cut away view of the cowling of the variable drag projectile stabilizer of FIG. 1 showing struts extending beyond the aft end of the cowling.
Figure 4B:
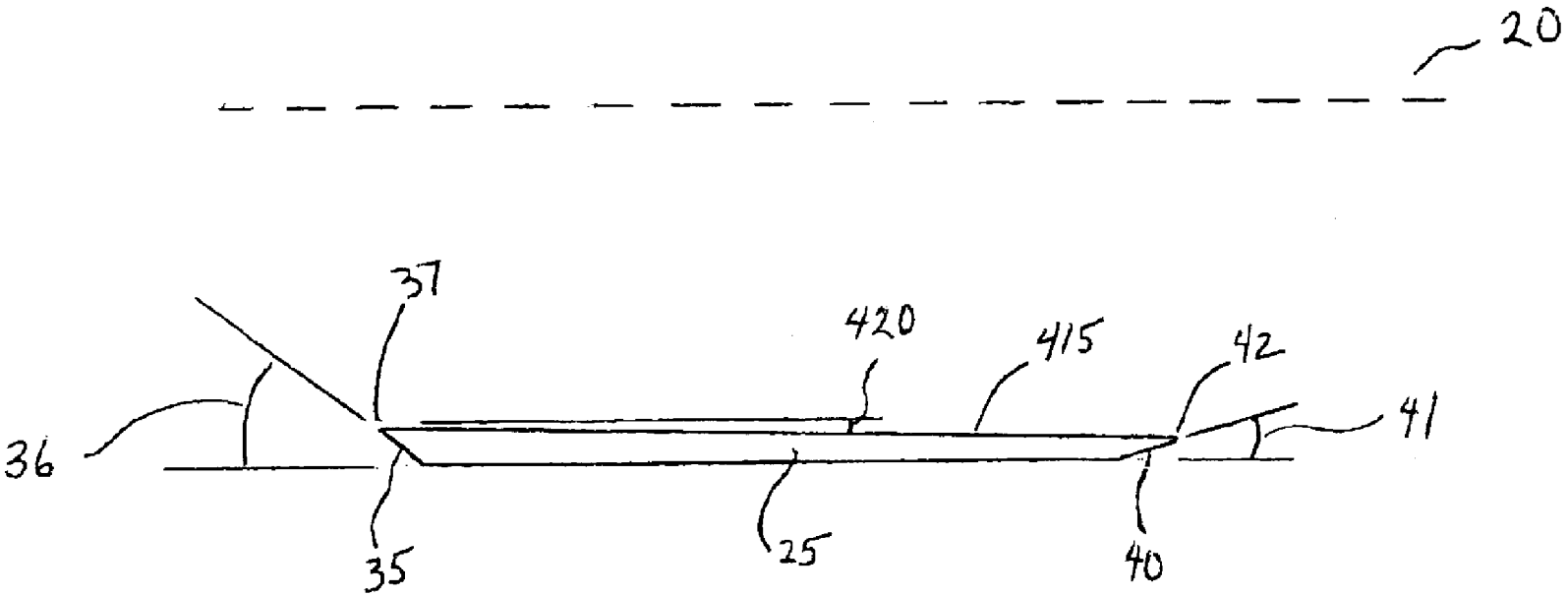
FIG. 4B is a sectional view of the cowling of the variable drag projectile stabilizer of FIG. 1 illustrating various design elements of the cowling.

With reference to FIGS. 4A and 4B, struts 30 extend beyond the trailing edge 37 of cowling 25 to carry the force (also known as the setback load) applied to cowling 25 during acceleration of the training projectile 100 in a gun tube. In an embodiment, the leading edges 305 of struts 30 are even with the leading edge 42 of cowling 25. In another embodiment, the leading edges 305 of struts 30 are located forward of the leading edge 42 of cowling 25.

Each of the struts 30 comprises angled surfaces 405. Each of the angled surfaces 405 is inclined at a strut surface angle 410 with respect to the longitudinal axis 20 of the training projectile 100. An angled interior surface 415 of cowling 25 is inclined at an interior surface angle 420 with respect to the longitudinal axis 20 of the training projectile 100. The angled surfaces 405 of struts 30 and the interior surface 415 of cowling 25 form converging ducts 205. The airflow through the ducts 205 is affected by the converging strut surface angle surfaces 405 and the interior cowling surface 415.

Stabilizer 10 comprises three struts 30. The strut surface angle 410 for each of the struts 30 relative to the longitudinal axis 20 is 2 degrees. The total included angle between the surfaces 405 on each strut 30 is approximately 4 degrees. In one embodiment, the strut surface angle 410 ranges from approximately 1.0 degree to approximately 5.0 degrees. In a further embodiment, stabilizer 10 may comprise 2 to 8 struts 30.

Stabilizer 10 comprises one annular cowling 25. The cowling leading edge bevel angle 41 relative to the longitudinal axis 20 is 5 degrees. In one embodiment, the leading edge bevel angle 41 ranges from approximately 1.0 to 10.0 degrees. The cowling trailing edge bevel angle 36 relative to the longitudinal axis 20 is 40 degrees. The trailing edge bevel angle 36 ranges from 10 to 90 degrees. The interior surface angle 420 relative to the longitudinal axis 20 is 2 degrees. The interior surface angle 420 ranges from approximately 0 to 5 degrees.

After launch from a gun tube, stabilizer 10 encounters supersonic airflow. The approaching supersonic airflow passes over the angled surfaces 405 of the struts 30 and the interior surface 415 of the cowling 25, creating oblique shock waves. The angle of the oblique shock wave formed from the angled surfaces 405 of the struts 30 is dependent upon the Mach number of the supersonic airflow and the angle of incidence of the angled surfaces 405, the strut surface angle 410. The angle of the oblique shock wave formed from the interior surface 415 of cowling 25 is dependent upon the Mach number of the supersonic airflow and the angle of incidence of the interior surface 415, the interior surface angle 420. The Mach number of the supersonic airflow varies from approximately 5.0 at launch of the training projectile 100 from the gun tube to less than 3.0 at the target location.

Figure 5A:
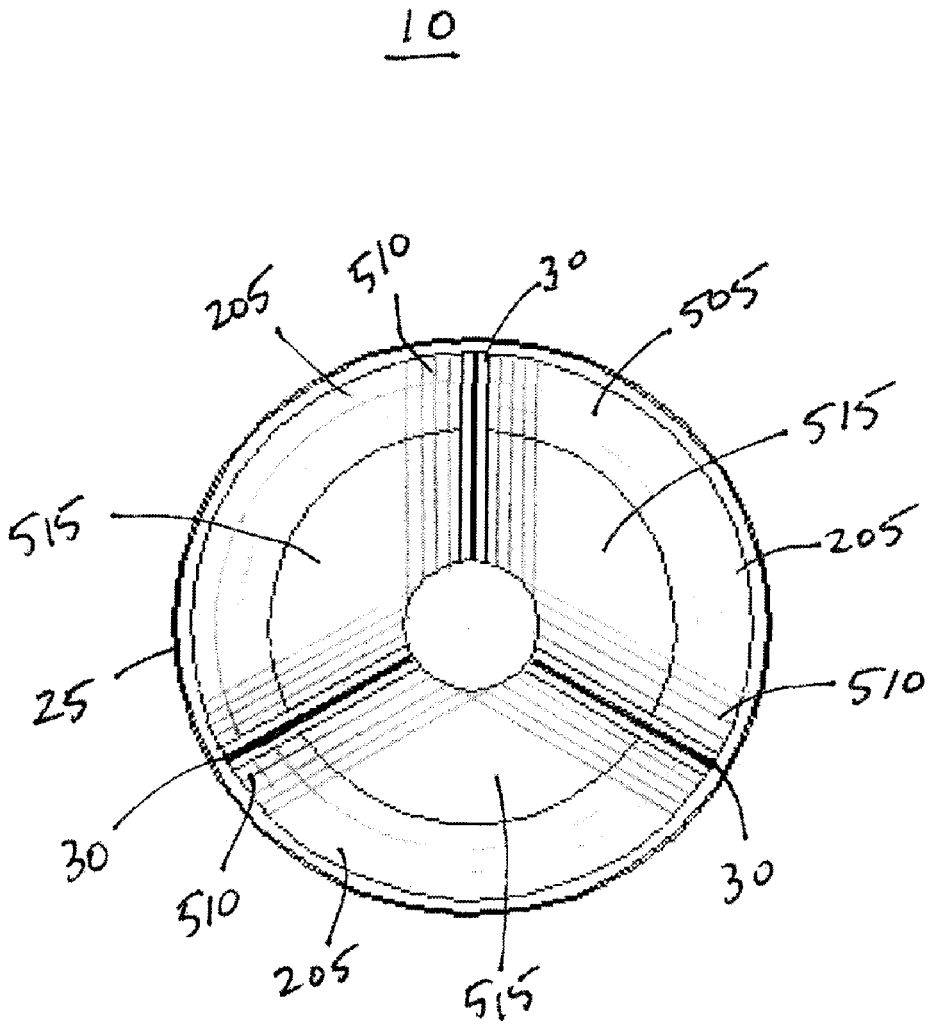
FIG. 5 is comprised of FIGS. 5A, 5B, and 5C and represents an end view of shock wave distribution in the variable drag projectile stabilizer of FIG. 1 operating at Mach 5.0, Mach 4.0, and Mach 3.0, respectively.
Figure 5B:
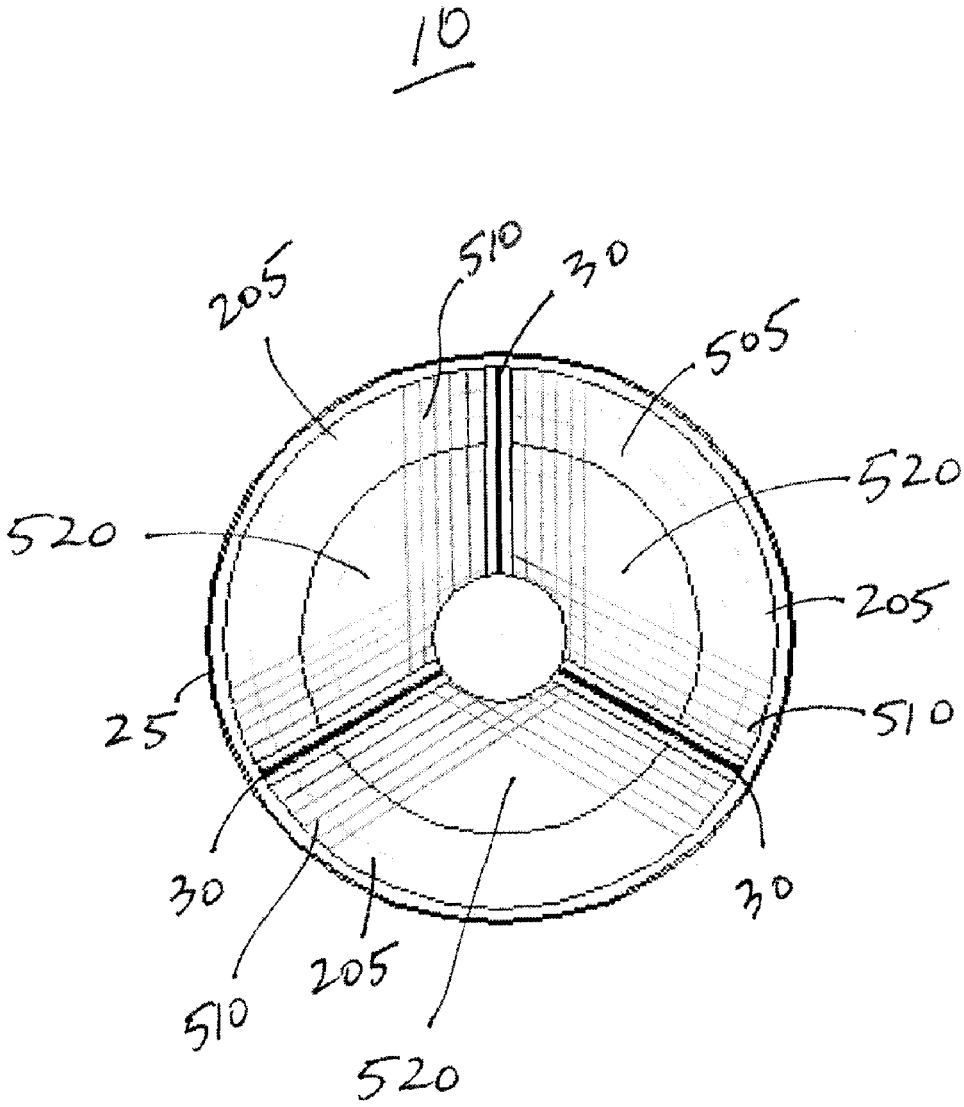
Figure 5C:
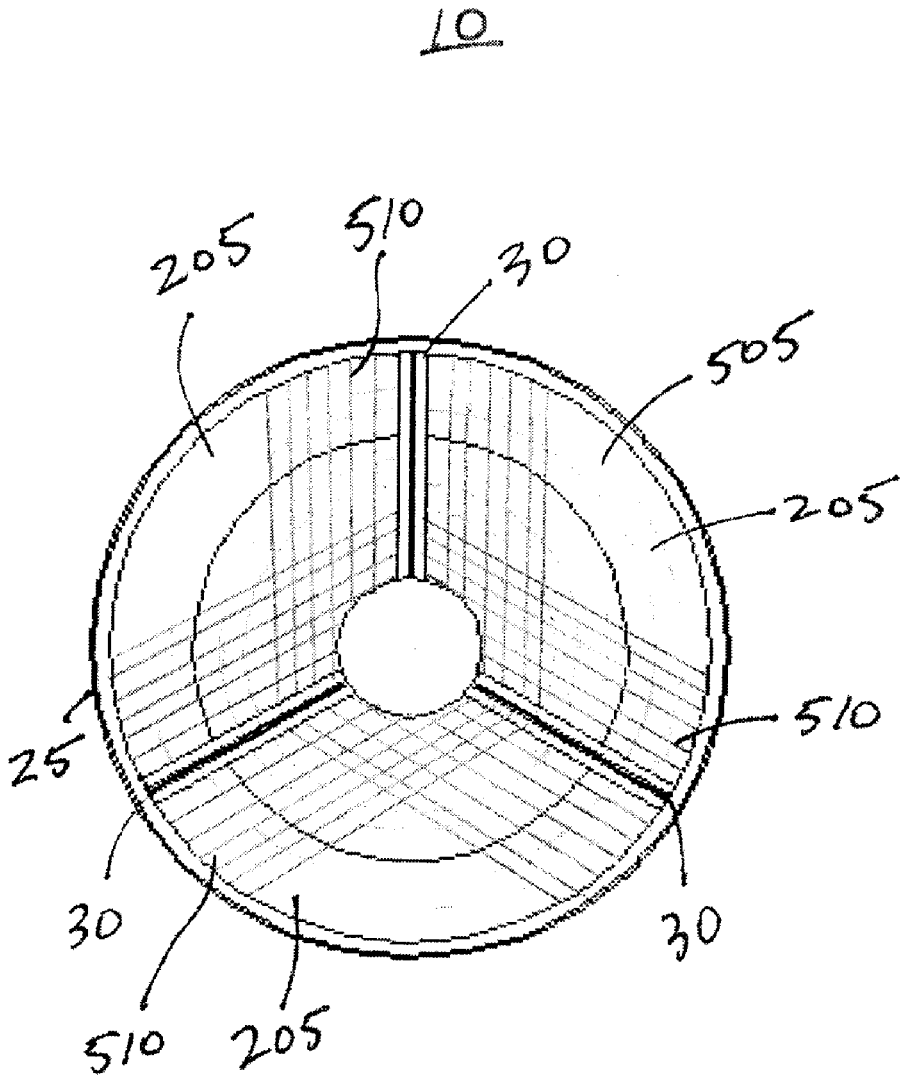

Performance of an exemplary stabilizer 10 during flight of the training projectile 100 is illustrated by a set of shock wave diagrams shown in FIG. 5 (FIGS. 5A, 5B, 5C), viewed from the aft end of stabilizer 10. FIG. 5A illustrates a shock wave distribution of airflow as the airflow exits stabilizer 10 at Mach 5, an approximate speed of the training projectile 100 at muzzle exit after launch from a gun tube. Shock waves 505 emanate off the cowling leading edge 42. Shock waves 510 emanate off the leading edges 305 of struts 30. Supersonic region 515 is a region in ducts 205 at Mach 5.0 in which supersonic airflow is unimpeded and free of shock waves.

As the training projectile 100 flies down range, the speed of the training projectile 100 decreases and the Mach number of the supersonic airflow through stabilizer 10 decreases. FIG. 5B illustrates a shock wave distribution of airflow as the airflow exits stabilizer 10 at Mach 4. Supersonic region 520 is a region in ducts 205 at Mach 4.0 in which supersonic airflow is unimpeded and free of shock waves. As illustrated by comparing supersonic region 515 at Mach 5.0 with supersonic region 520 at Mach 4.0, the decrease of Mach number has increased the area of interference of shock waves 505 and 510 and decreased the area available for supersonic air flow to that of supersonic region 520.

As the training projectile 100 reaches the desired down range location, the Mach number of the supersonic airflow through stabilizer 10 decreases to Mach 3. FIG. 5C illustrates a shock wave distribution of airflow as the airflow exits stabilizer 10 at Mach 3. Shock waves 505 emanating from the leading edge 42 of cowling 25 and shock waves 510 emanating from the leading edge 305 of struts 30 have filled the interior area of ducts 205 such that supersonic flow is no longer present. The transition from supersonic flow to subsonic flow (also known as "choking") in ducts 205 causes a large increase in aerodynamic drag, limiting the maximum range of the training projectile 100.

Figure 6A:
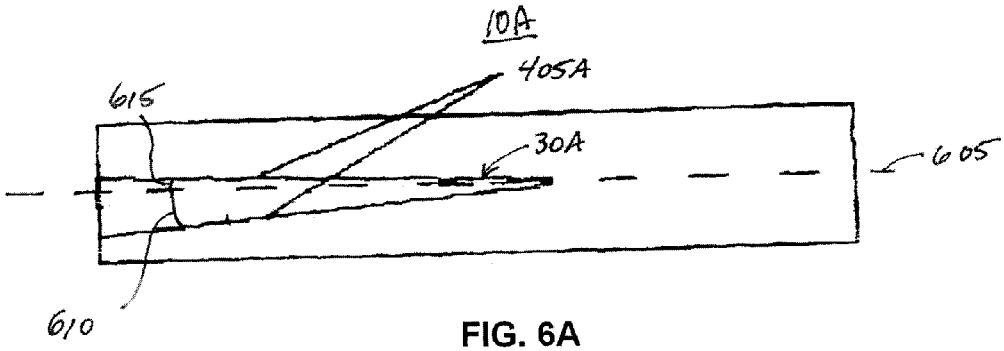
FIG. 6 is comprised of FIGS. 6A, 6B, 6C, and 6C and represents cut away views of the variable drag projectile stabilizer of FIG. 1 illustrating various embodiments of configurations of the struts.
Figure 6B:
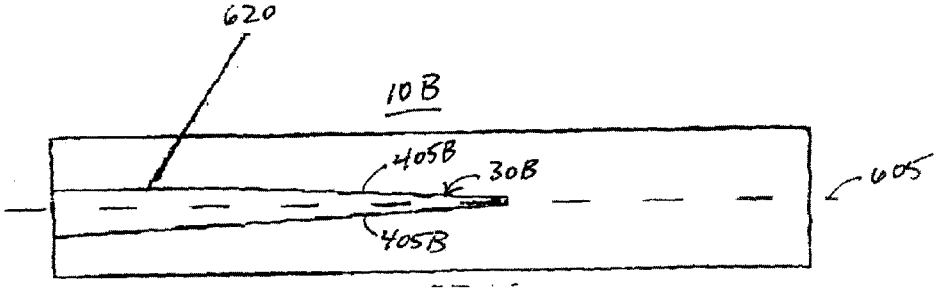
Figure 6C:
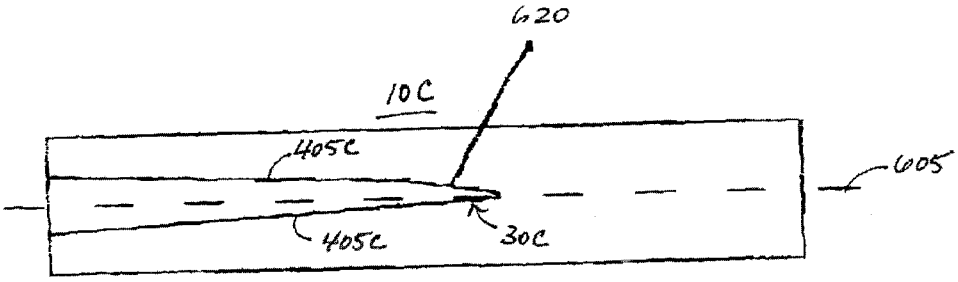

FIG. 6 (FIGS. 6A, 6B, 6C) illustrates various configurations for the angled surfaces 405 of struts 30. Stabilizer 10 (FIG. 1) utilizes a configuration of struts 30 that is symmetric about a longitudinal axis 20 of the stabilizer 10. It is often desirable to induce spin in a training projectile during flight, enhancing target accuracy of the training projectile. In an embodiment illustrated by a cut away view of stabilizer 10A shown in FIG. 6A, struts 30A of stabilizer 10A utilize asymmetrically angled surfaces 405A as a method of inducing spin. The asymmetric configuration of struts 30A causes a higher pressure on one side of struts 30A, resulting in a roll torque about the longitudinal axis 605 of the stabilizer 10A. Angled surfaces 405A are configured asymmetrically with respect to longitudinal axis 605; for example, angle 610 is greater than angle 615. Conversely, angle 615 may be greater than angle 610.

In a further embodiment illustrated by a cut away view of stabilizer 10B shown in FIG. 6B, asymmetry of struts 30B is introduced in a trailing edge 620 of one of the angled surfaces 405B of each of the struts 30B. In yet another embodiment illustrated by a cut away view of stabilizer 10C shown in FIG. 6C, asymmetry of struts 30C is introduced in a leading edge 620 of one of the angled surfaces 405C of each of the struts 30C.

Figure 7B:
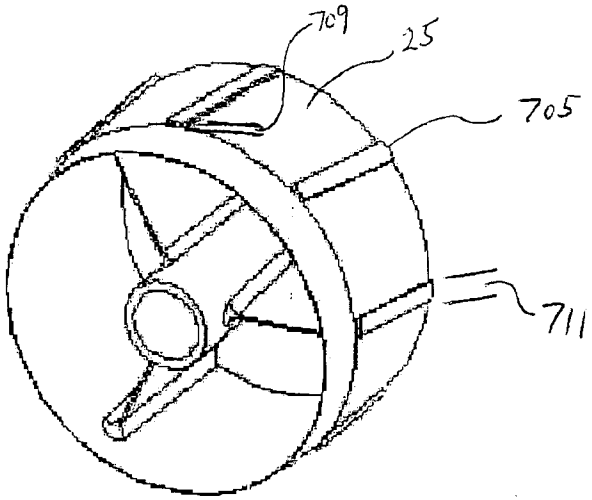
FIG. 7 is comprised of FIGS. 7A and 7B and shows the stabilizer with angled strakes placed around the periphery of the cowling to induce spin during flight.
Figure 7A:
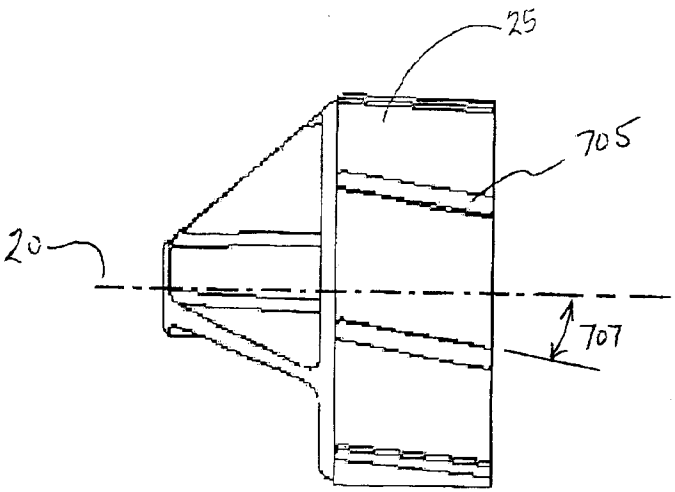

In an embodiment illustrated by a diagram of stabilizer 10D shown in FIG. 7A and FIG. 7B, spin is introduced during flight of a training projectile by utilizing angled strakes 705 placed around the periphery of cowling 25D. The strakes 705 also provide structural support to the cowling 25 during setback load during acceleration and act as bore riding surfaces as the projectile travels along the gun tube. The angle 707 of the strakes 705 relative to the axis 20 is approximately 5 degrees. In an embodiment, the strake angle 707 ranges from approximately 2.0 degrees to approximately 10.0 degrees. The height 709 of the strakes 705 above the surface of the cowling 25 is approximately 0.10 inch. In an embodiment the strake height 709 varies from approximately 0.03 inch to approximately 0.15 inch. The width 711 of the strakes is approximately 0.15 inch. In one embodiment the strake width 711 varies from approximately 0.06 inch to approximately 0.25 inch. In a further embodiment, stabilizer 10 may contain 3 to 12 strakes 705.

When the training projectile 100 is launched from a gun, gun gases flow forward through ducts 205 creating a pressure differential between the inside and outside of cowling 25 in which the pressure inside cowling 25 is significantly higher than outside cowling 25. In an embodiment, the outside diameter D, 50, of cowling 25 is designed smaller than the gun bore, allowing the gun gases to flow outside the cowling 25, thus reducing the pressure differential.

Figure 8:
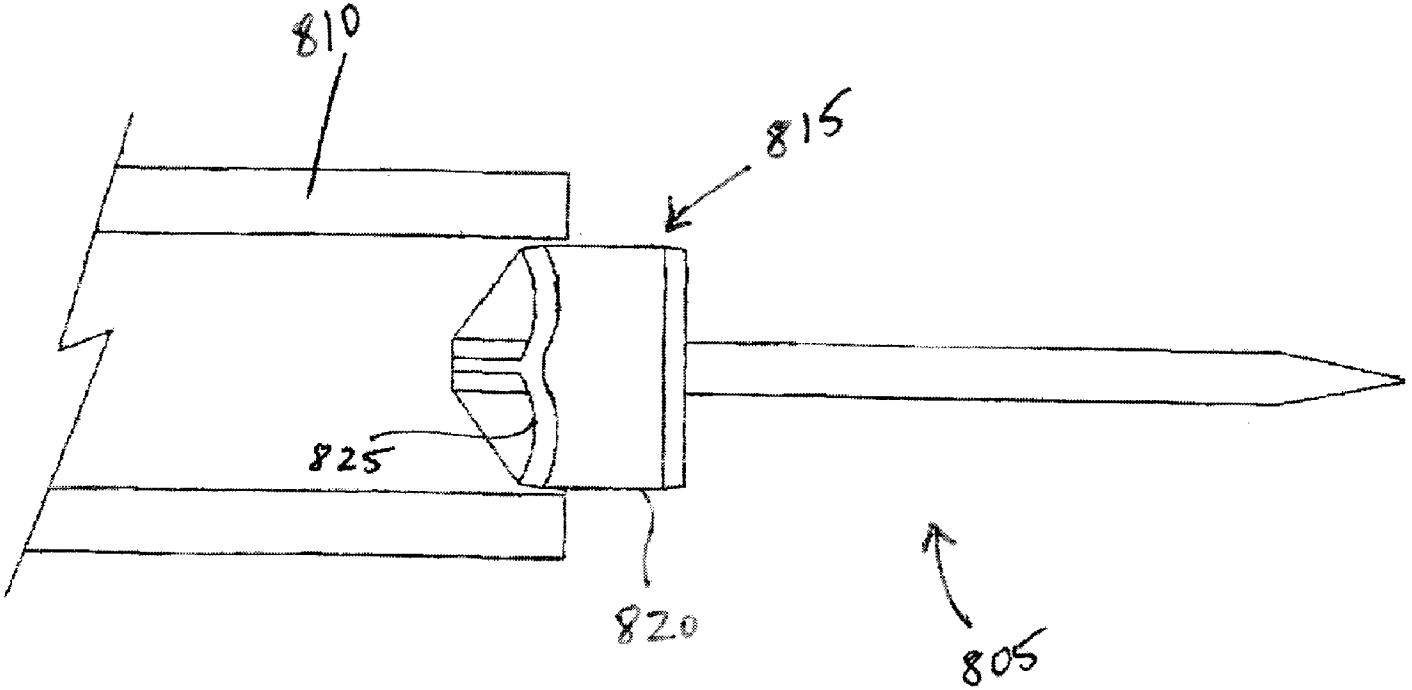
FIG. 8 is a cut away view of the training projectile exiting a gun tube with an embodiment of the variable drag projectile stabilizer of FIG. 1 utilizing a cowling with scalloped trailing edges.

An embodiment for further reducing the pressure differential between the inside and outside of a cowling is illustrated by the diagram of FIG. 8. FIG. 8 is a cut away view of a training projectile 805 exiting a gun barrel 810. The training projectile 805 comprises a stabilizer 815. The stabilizer 815 comprises a cowling 820. Cowling 820 comprises a trailing edge 825 that is scalloped to allow the gun gases to escape more rapidly to the outside of cowling 820, further reducing the pressure differential between the inside and outside of cowling 820.

It is to be understood that the specific embodiments of the invention that have been described are merely illustrative of certain applications of the principle of the present invention. Numerous modifications may be made to the variable drag projectile stabilizer limiting a flight range of a training projectile described herein without departing from the spirit and scope of the present invention. Moreover, while the present invention is described for illustration purpose only in relation to a training projectile, it should be clear that the invention is applicable as well to, for example, any projectile for which a method of limiting flight range may be used.

What is claimed is:

1. A variable drag projectile stabilizer for limiting a flight range of a training projectile, comprising:

a cowling, comprising a cowling leading edge;

a plurality of struts for supporting the cowling, wherein said struts comprise a plurality of strut leading edges and a plurality of strut trailing edges, and the strut leading edges extend forward of the cowling leading edge;

a plurality of ducts formed by the cowling and the struts;

a plurality of angled surfaces on each of the struts for introducing a first set of oblique shock waves in a supersonic flow of air through the ducts;

an angled interior surface of the cowling for introducing a second set of oblique shock waves in the supersonic flow of air through the ducts;

wherein at launch of the training projectile, interaction of the first set of oblique shock waves with the second set of shock oblique waves permits supersonic flow through the ducts resulting in a relatively low aerodynamic drag on the training projectile, wherein as the training projectile decreases in velocity the first set of oblique shock waves and the second set of oblique shock waves increase in interaction and the supersonic flow of air through the ducts is choked, causing an increase in aerodynamic drag to the training projectile;

wherein the small amount of drag allows the training projectile to closely match a flight characteristic of a corresponding service projectile; and wherein the large amount of drag limits the flight range of the training projectile to a predetermined distance.

* * * * *